United States Patent [19]

Steiner et al.

[11] 4,429,859

[45] Feb. 7, 1984

[54] CONCENTRATED SOFTENING COMPOSITION FOR TEXTILE FIBERS

[75] Inventors: Jean-Pierre Steiner, Versailles; Christiane Melin, Courbevoie; Jean-Francois Platon, Courbevoie; Nicole Peton, Ivry sur Seine, all of France

[73] Assignee: Lesieur-Cotelle & Associes, Boulogne Billancourt, France

[21] Appl. No.: 467,863

[22] Filed: Feb. 18, 1983

Related U.S. Application Data

[63] Continuation of Ser. No. 262,269, May 11, 1981, abandoned.

[30] Foreign Application Priority Data

May 14, 1980 [FR] France ..... 8010905

[51] Int. Cl.[3] ..... D06M 13/20; D06M 13/46

[52] U.S. Cl. ..... 252/8.8; 252/8.6

[58] Field of Search ..... 252/8.8

[56] References Cited

U.S. PATENT DOCUMENTS 3,325,404 6/1967 Cohen et al. .
3,395,100 7/1968 Fisher et al. .
3,915,867 10/1975 Kang et al. .
3,959,157 5/1976 Inamorato .
3,963,629 6/1976 McLaughlin .
4,140,641 2/1979 Ramachandran .
4,214,998 7/1980 Joy .
4,264,457 4/1981 Beeks et al. .
4,322,302 3/1982 Kleber et al. .
4,326,965 4/1982 Lips et al. .
4,351,737 9/1982 Billenstein et al. ..... 252/8.8

FOREIGN PATENT DOCUMENTS 2426581 12/1974 Fed. Rep. of Germany .
2459354 6/1976 Fed. Rep. of Germany ..... 252/8.8
2295122 12/1975 France .

*Primary Examiner*—Maria Parrish Tungol
*Attorney, Agent, or Firm*—Brumbaugh, Graves, Donohue & Raymond

[57] ABSTRACT

This invention concerns a concentrated softening composition for textile fibers characterised in that it includes active softening agents constituted by one or several specific cationic agents representing 10 to 30% by weight of the whole composition and one or more nonionic agents acting as emulsifying or stabilising agents for the cationic or cationics, as well as one or more solvents of the methanol, ethanol, isopropanol or glycol type, combined so as to give a concentrated solution having an appropriate consistency for storage in a flexible plastic dose and capable of being diluted in tap water by simple agitation.

11 Claims, No Drawings

CONCENTRATED SOFTENING COMPOSITION FOR TEXTILE FIBERS

This is a continuation of application Ser. No. 262,269, filed May 11, 1981, now abandoned.

The present invention refers to a concentrated softening composition for textile fibres.

Softening compositions are generally constituted by 3 to 10% of active softening agents and 90 to 97% of demineralised water. The active softening agents are generally either cationic surface-active compounds (most often quaternary ammonium compounds including at least 2 long chain alkyl groups), or mixtures in variable proportions of cationic surface-active agents and non-ionic surface-active agents, which are combined with additional additives such as perfumes, optical bluing agents, colouring agents, preservatives, bacteriacides, thickeners, etc.

These compositions have the disadvantage of only being capable of being manufactured and used commercially in a highly diluted form, because it has been shown, that a concentration greater than 10% transforms them into gels which are not dispersable in water when they are used by the housewife.

Moreover, the industrial manufacturer is obliged to use for the manufacture of his product demineralised water from which the electrolytes have been practically eliminated, so as to obtain an emulsion having an acceptable homogeneity, stability, and consistency at the time of use.

This requires supplementary technological operations for the demineralisation of tap water and at the same time the use, for a predetermined softening power, of a voluminous and heavy packaging and over-packaging.

These disadvantages affect the consumer, not only at the level of the selling price of the product, but equally concerning transport and storage, given that they necessitate transport and storage of a substantial volume and weight for a relatively small softening effect.

The object of the present invention is to remedy these disadvantages by proposing a concentrated softening composition which is not in the form of a non-dispersible gel, but in the form of a stable viscous solution which is totally miscible with even cold tap water, and thus water which need not be demineralised in advance.

In this way, the user, especially the housewife, finds after dilution in tap water and by simple agitation the product which she uses habitually, that is to say a homogeneous stable solution having a consistency identical to that of the commercially-available products, that is to say products sold by the manufacturer in the form of a viscous dilute solution.

The choice of an appropriate viscosity is essential for this product. Thus, if during a decantation, a product which is too viscous causes problems in passing from one vessel to the other, a product which is too fluid has the major disadvantage of overflowing and splashing disagreeably for the housewife who has to measure the product before introducing it into the rinsing water, and presents at the same time a risk of fouling and eventually corrosion of the washing machine.

The concentrated product according to the invention can thus give by simple dilution, for example in tap water, a product which is perfectly adapted to the dimensions of the softener containers of clothes washing machines at present commercially available.

Moreover, the product according to the invention is conceived, in contrast to the commercially-available diluted softening products, for clothes washing machines of recent design, provided with a reservoir for softener capable of providing a reserve of the product for one to two months so as to facilitate the work of the housewife. Effectively, the product of the invention possesses two qualities which are essential for such machines: an increased concentration which permits the use of a reservoir of relatively small dimensions, thus easier to house in such machines, and a prolonged stability under temperature cycles to which it is subjected in the reservoir of the washing machine. These qualities make it equally usable in industrial washing machines.

For this purpose, the composition according to the invention is characterised in that it comprises active softening agents constituted by one or several specific cationic softening agents, representing 15–30% by weight of the whole composition, and one or several non-ionic agents acting as emulsifying or stabilising agent for the cationic agent or agents, and if required additives such as perfumes, emulsifying agents for perfumes, colouring agents, optical bluing agents, preservatives as well as one or more solvents of the type methanol, ethanol, isopropanol or glycols.

Thus, the invention is based on the provision of a composition having a concentration of active agents, which is approximately four to six times greater than the concentration of the compositions at present on the market, and capable of giving after dilution with tap water a solution having a stability and a homogeneity comparable to conventional solutions and even having improved softening properties and an improved absorbent property in comparison to the prior art.

The choice of components and their proportions have been studied so as to obtain a composition having a viscosity which permits easy and homogeneous dilution; it can be diluted four to six times with cold tap water and has the same final appearance as the conventional products and thus can be used in the same manner in washing machines of conventional type, and for use during washing by hand.

The concentrated product can be packed either in rigid plastic packaging, or in flexible plastic packaging. But, this packaging is an intermediate packaging, since the product must be diluted before use. It is thus preferable to use a flexible plastic container in the form of a single measured dose or for example a tetrahedral carton, because a tetrahedral carton of flexible plastic can be completely emptied of the product which it contains by pressing the walls onto one another, whilst a container of rigid plastic must be rinsed to be completely emptied. Another advantage of this kind of packaging is that it takes up less space during storage, whilst the space necessary for storing the doses is 1.4 times the volume of the dose whereas to store rigid plastic containers, the space necessary is from 2 to 2.5 times the volume of the product held in the container, depending on the shape of this latter. The manufacture of a container of flexible plastic is much less difficult than of a container of rigid plastic. All these reasons are in favour of a container, the only functions of which are transporting and storing of the product in the simplest, easiest, and least onerous conditions. The use of the product takes place from a vessel in which the product is diluted, and this vessel can be reused numerous times. The volume of the flexible container can be adapted to the final desired dilution. The usual capacities go, for example, from 50 to 500 $cm^3$ for a final dilution taking the volume to 1000 $cm^3$. The product of the invention may, for example, be stored in a tetrahedral carton having a volume of 250 $cm^3$. Thus, when he buys a dose of the product, the user carries in a 250 $cm^3$ container as much softening power as in a vessel of 1000 $cm^3$ bought commercially.

The product sold in this type of container offers all guarantees to the user to whom it permits, after the initial dilution with tap water, there to be obtained a homogeneous dispersion which is stable on storage and which has a viscosity comparable to that of products sold in diluted form.

Moreover, the relationship composition/water/solvent is calculated so as to obtain a product which can be stored in doses of which the viscosity is calculated to allow the dose to be filled and emptied rapidly, easily, and completely.

Consequently, in the case of a product stored in plastic tetrahedral cartons, for example 250 $cm^3$ in volume, the user can transfer the product to a one-liter vessel, then fill with tap water which need not be of a special quality and, after agitation of the container, obtain a product which is ready for use either by hand or in a machine. The product thus obtained has the viscosity expected by the user, which allows him to dispense the correct quantity of the product in a constant manner.

According to another characteristic of the invention, the weight ratio of cationic softeners to non-ionic agents is between 10/1 and 3/2.

In the composition which is the object of the invention, the main constituent is thus the cationic surface active agent or agents which can be constituted by various types of composition which will be explained below:

(a) quaternary ammonium compounds of the general formula:

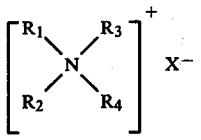

in which formula $R_1$ and $R_2$ represent either alkyl groups having preferably 10 to 22 carbon atoms, or alkyl chains interrupted by functional groups such as hydroxy, carboxy, amide, ethoxy; $R_3$ and $R_4$ representing alkyl or hydroxy alkyl groups having 1 to 4 carbon atoms, and X is a halide, methylsulphate, or ethylsulphate anion.

Among these quaternary ammonium compounds, there can be cited most particularly di-tallow-dimethyl ammonium chloride, di-hydrogenated tallow-dimethyl ammonium chloride, dioctadecyldimethyl ammonium chloride, diethyl-dimethyl-stearyl ammonium chloride, distearyl-dimethyl ammonium methylsulphate, di(stearoyl-oxyethyl-)dimethyl ammonium chloride, di(lauryl-hydroxypropyl-)dimethyl ammonium chloride, di(stearoyl-oxyethyl-)dimethyl ammonium chloride, di(palmytoyl-oxyethyl-)dimethyl ammonium chloride, di(steroyl-oxyethyl-)hydroxyethyl-methyl ammonium methylsulphate, di(palmitoyl-oxyethyl-)hydroxyethyl-methyl ammonium methylsulphate, di(oleoyl-oxyethyl-)hydroxyethyl-methyl ammonium methylsulphate, di(-stearoyl-oxyethyl-)hydroxyethylmethyl ammonium ethylsulphate, di(palmitoyl-oxyethyl-)hydroxyethyl-methyl ammonium ethylsulphate, di(oleoyl-oxyethyl-)hydroxyethyl-methyl ammonium ethylsulphate.

Nevertheless, in this category, the compounds preferably used are di-hydrogenated tallow dimethyl ammonium chloride, di-tetradecyl-dimethyl ammonium chloride and preferably, di(stearoyl-oxyethyl-)methyl-hydroxyethyl ammonium methylsulphate, di(palmitoyl-oxyethyl-)methyl-hydroxyethyl ammonium methylsulphate, and di(oleoyl-oxyethyl-)methyl-hydroxyethyl ammonium, methylsulphate, alone or as mixtures.

(b) alkyl imidazolinium salts such as for example the methyl-sulphate of 2. heptadecyl 1-methyl -1-(2.stearoylamido) ethyl-imidazolinium, the chloride of 2.heptadecyl 1-methyl 1-(stearoylamido) ethyl-imidazolinium or of the ethylsulphate of ethyl 1-stearoylamido ethyl-alkyl 2.imidazolinium.

(c) amine salts, of the general formula:

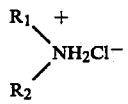

in which formula $R_1$ and $R_2$ are alkyl groups, hydroalkyls, or alkyl radicals interrupted by the functional groups carboxy, ethoxy, hydroxy, or amide.

As examples of these products, there can be cited the products of the general formulas:

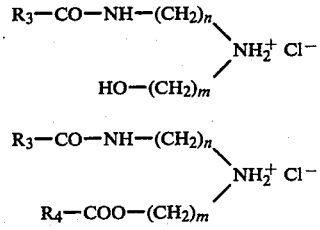

in which formulas $R_3$ and $R_4$ are alkyl radicals having preferably between 10 and 22 carbon atoms, m and n being preferably between 1 and 6.

Certainly, the list of examples of compositions given above (a, b, c) is not limiting and products belonging to the three classes of cationic agents of the same type can be used alone or as mixtures.

According to another characteristic of the invention, the non-ionic agent or agents are chosen within the group formed by the fatty alcohols containing 8 to 20 carbon atoms condensed with 3 to 12 molecules of an alkylene oxide (preferably ethylene and/or propylene) and the alkylphenols containing an alkyl radical having 8 to 10 carbon atoms condensed with 4 to 12 molecules of alkylene oxide (preferably ethylene and/or propylene).

Thus, the characteristics are due to a composition containing a specific cationic with the addition of one or several appropriate non-ionics. There is obtained, after an initial dilution with cold tap water, the dispersion having a homogeneity and a physical stability which could never be obtained in the prior art, which is indispensible for storing a concentrated product, in the form of a dose in a plastic material of which the price is very low in comparison with the prior art packaging.

Further, this composition remains stable within very wide temperature limits ranging from those which can be attained in the storage container of washing machines during the course of washing and can, besides, resist a storage temperature as low as minus 25° C. while still returning to its initial consistency after thawing.

Nevertheless, to permit them to aspire to a large distribution among the public, it is essential to add to the compositions, which are the object of the invention, a substantial quantity of perfume.

Further, according to another characteristic of the invention, there are added to the composition oil-in-water emulsifying agents having an HLB (hydrophilic-lyophilic balance) value between 10 and 16, belonging to the class of non-ionics; such agents are preferably sorbitan esters and/or poly-oxy-ethylenated sorbitan esters.

In fact, in the composition of the present invention, it has been found that the addition of a very small quantity of these products permits there to be obtained an incorporation of perfumes without subsequent phase separation, and stability during a long period of storage.

Besides, the addition in selected quantities of a solvent or a mixture of solvents of the methanol, ethanol, isopropanol, or glycol type is necessary for the adjustment of the viscosity and in order to obtain a well homogenised and finely dispersed emulsion.

The particularly valuable properties of the compositions which are the object of the invention will be shown with reference to the following tests, in which the softening properties of these compositions are compared with those of a conventional product based on di-hydrogenated tallowdimethyl ammonium chloride.

For that, there are washed in a domestic washing machine terry towels and cotton percale fabrics with a standardised washing powder and there are introduced into the washing machine 60 $cm^3$ of softening composition for the final rinsing. The terry towels and the cotton percale fabrics are dried vertically.

(a) Softening ability.

This test is carried out on the terry towels: a panel of experienced individuals judges the feel of the towels and notes each product with reference to the reference product.

The reference product is noted O.

Products having a superior feel to the reference are noted as + to +++.

The products having an inferior feel to the reference are noted as − to −−−.

(b) Wetting property

The conventional compositions which have a good softening property have the disadvantage of rendering fabrics hydrophobic, that is to say that the fabrics lose part of their absorbent properties, which is disagreeable, especially for terry towels of which the principal function is to absorb water.

This test is carried out on cotton percale. There is measured the capillary rise of an aqueous solution on test pieces of cloth 2 cm wide. The percentage of wetting with reference to a reference fabric which has been washed and not softened is noted.

Reference composition

There are dispersed under strong agitation 66.66 g of 75% di-hydrogenated tallow-dimethyl ammonium chloride in 928 g of demineralised water at 60° C. and containing 5 g of nonylphenol condensed with 9 molecules of ethylene oxide. A softening solution containing 5% of cationic agent is obtained.

EXAMPLE 1

There are mixed at 40° C., 235 g of an 85% solution of methylsulphate N methyl, NN di($\beta C_{14}C_{18}$-acyloxyethyl), N-$\beta$ hydroxyethyl ammonium with 20 g of oxyethylenated fatty alcohol and 80 g of isopropanol. This preparation is dispersed in 700 g of tap water containing the colourant. There is then added the perfume dispersed by an oxy-ethylenated sorbitan ester. There is obtained an opaque and homogeneous composition with 20% of softening material having a sufficiently low viscosity of 200 to 300 millipascals/second so that the product disperses easily in water (the viscosity is determined by means of a viscosimeter of the EPPRECHT TVB mobile 2 type).

250 g of this composition are placed in a vessel, 750 g of cold tap water are added, and with agitation of the vessel there is obtained a softening composition of which the viscosity is identical to that of existing products: 40 to 80 millipascals. second and of which the softening qualities are superior to those obtained with the di-hydrogenated tallow-dimethyl ammonium chloride instead of this cationic. Further, fabrics softened with this composition have a wetting ability greater than those softened with the reference composition (see Table 1 attached).

EXAMPLE 2

Example 1 is repeated, but in which there are added 5 g of oxyethylenated nonylphenol, before the addition of the mixture of perfume and oxyethylenated sorbitan ester. There is obtained an opaque and homogeneous composition of which the viscosity is between 100 and 200 millipascals.second.

250 g of this composition are placed in a 1 liter vessel and 750 g of tap water is added followed by agitation. There is obtained a well-dispersed softening composition of which the viscosity is comprised between 40 and 80 millipascals.second.

The fabrics treated with this composition are of the same qualities as those treated in accordance with Example 1.

EXAMPLE 3

Example 1 is repeated and there are added 5 g of a $C_{12}$–$C_{14}$ fatty alcohol oxyethylenated with 9 molecules of ethylene oxide, and the procedure as in Example 2 is followed.

There is obtained a product of which the viscosity is from 200 to 300 millipascals.second and of which the softening properties are identical to those of Example 2.

EXAMPLE 4

Example 3 is repeated, and there are added 10 g of $C_{12}$–$C_{14}$ oxyethylenated fatty alcohol and one operates as in Example 3.

There is obtained a composition having a viscosity comprised between 700 and 900 millipascals.second. This composition is very difficult to pour and dilution in tap water is very difficult, it is necessary to carry out a very energetic agitation to obtain a dilute homogeneous solution.

With this dilute and homogeneous solution, there are obtained the same softening properties and the same wetting property as in Example 3.

EXAMPLE 5

There are poured, under strong agitation, 700 g of a 30% solution of amine chlorides and non-ionics of which the cationic/non-ionic ratio=8/2, in cold tap water containing the colourant. After agitation, the perfume is added and there is obtained an opaque, homogeneous and stable composition having a viscosity of 200 to 300 millipascals.second, the product dispersing easily in tap water.

250 g of this composition are placed in a one liter vessel and 750 g of tap water added following by stirring. There is obtained a softening composition having a low viscosity of 6 to 10 millipascals.second. This composition has good softening properties, the wetting property is comparable to the reference composition.

EXAMPLE 6

35% of the preparation of Example 1 and 65% of the preparation of Example 2 are mixed. There is obtained a product with 20% of softening products. This product has a viscosity of 250 to 350 millipascals.second and it disperses easily in cold tap water.

Diluted 4 times, there is obtained a product of low viscosity, 6 to 10 millipascals.second, which has good softening properties and wetting properties comparable to the reference composition.

EXAMPLE 7

There is poured under strong agitation 66.4 g of 75% ethylsulphate of ethyl-1-stearoylamido ethyl-alkyl 2-imidazolinium, melted, with 729.6 g of demineralised water at 60° C. containing 4 g of sodium paratoluene sulfonate.

There is obtained a product with 20% of softening products which has a viscosity of 450 to 550 millipascals.second and it disperses easily in cold tap water.

Diluted 4 times in tap water, there is obtained a softening product of low viscosity of which the softening properties are slightly inferior to those of the reference composition.

TABLE 1

| VISCOSITY | REFERENCE | EX. 1 | EX. 2 | EX. 3 | EX. 4 | EX. 50 | EX. 6 | EX. 7 |
|---|---|---|---|---|---|---|---|---|
| in millipascal second | | | | | | | | |
| Concentrated product | – | 200–300 | 100–200 | 200–300 | 700–900 | 200–300 | 250–350 | 450–550 |
| Diluted product | 60–80 | 40–80 | 40–80 | 40–80 | 40–80 | 5–10 | 5–10 | 5–10 |
| Softening power | 0 | + | + | + | + | 0 | 0 | – |
| Wetting power | 30–35% | 50–60% | 50–60% | 50–60% | 50–60% | 30–35% | 30–35% | 40–45% |

*In Example No. 1, 2, 3, 4, it is noticed that the quality of the wetting power is clearly improved with reference to that of the other compositions. This quality is very important because it permits there to be obtained cotton laundry having an attractive softness and a good capacity for absorbing moisture.

We claim:

1. A concentrated softening composition for textile fibers comprising:

12 to 30% by weight of the total weight of the composition as an active cationic softening agent at least one quaternary ammonium compounds having the general formula

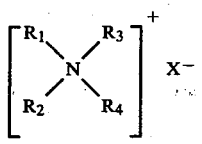

wherein $R_1$ is a carboxy alkyl group having from 10 to 22 carbon atoms, $R_2$ is a carboxy alkyl group having from 10 to 22 carbon atoms, $R_3$ is an alkyl group having 1 to 3 carbon atoms, $R_4$ is an hydroxy alkyl group having 1 to 4 carbon atoms, and X is an anion selected from the group consisting of a halide, methylsulphate and ethylsulphate; at least one non-ionic emulsifying agent; one or more solvents selected from the group consisting of methanol, ethanol, isopropanol and glycol type solvents representing 5 to 12% of the total weight of the composition; said emulsifier and said solvent effective to give a viscosity below 400 mp/s to the mixed concentrate, a viscosity of 40–80 mp/s to the concentrate diluted by a 4:1 ratio, and improved stability to the softener composition.

2. A softening composition according to claim 1, wherein said cationic softening agent is selected from the group consisting of methylsulfate of N-methyl, N,N-di($\beta C_{14}$-$C_{18}$ acyloxy-ethyl), N-$\beta$ hydroxy ethyl ammonium; ethylsulfate of N-methyl, N,N-di ($\beta C_{14}$-$C_{18}$ acyloxy-ethyl), N-$\beta$ hydroxy ethyl ammonium and mixtures thereof.

3. A softening composition according to claim 1, wherein said cationic softening agent is selected from the group consisting of methylsulfate of di (stearoyl-oxyethyl-) methylhydroxyethyl ammonium, ethylsulfate of di (stearoyl-oxyethyl-) -methyl-hydroxyethyl ammonium, or mixtures thereof.

4. A softening composition according to claim 1, wherein the weight ratio of the cationic softening agent to the non-ionic emulsifying or stabilizing agent is between 10/1 and 3/2.

5. A softening composition according to claim 1, wherein the emulsifying agent for the cationic softening agent is a mixture of (a) non-ionic agent selected from the group consisting of fatty alcohols containing from 8 to 20 carbon atoms condensed with 3 to 12 molecules of alkylene oxide, or alkyl-phenols containing an alkyl radical having 8 to 10 carbon atoms condensed with 4 to 12 molecules of alkylene oxide; and (b) polyoxyethylenated sorbitan esters.

6. A softening composition according to claim 5, wherein said emulsifying agent is a mixture of (a) non-ionic agent selected from the group consisting of fatty alcohols containing 8 to 20 carbon atoms condensed with 3 to 12 moles of a material selected from the group consisting of ethylene oxide, propylene oxide and mixtures thereof, and alkylphenols containing an alkyl radical having 8 to 12 carbon atoms condensed with 4 to 12 moles of a material selected from the group consisting of ethylene oxide, propylene oxide and mixtures thereof, and (b) polyethyleneate sorbitan esters.

7. A softening solution for textile products having a viscosity of 40 to 80 mp/s containing the concentrated composition defined in claim 1 diluted between 3 and 10 times in tap water.

8. A process for preparing a softening solution for textile products which comprises diluting the softening composition of claim 1, 3 to 10 times in tap water to thereby obtain a solution having a viscosity of 40 to 80 mp/s.

9. A softening solution for textile products having a viscosity of 40 to 80 mp/s containing the concentrated composition defined in claim 1 diluted between 4 and 6 times in tap water.

10. A softening composition as described in claim 5 wherein said sorbitan esters have an HLB value of 10 to 16.

11. A softening composition according to claim 1 wherein the composition also contains additives selected from the group consisting of perfumes, perfume emulsifying agents, colorants, optical bluing agents and preservatives.

* * * * *

UNITED STATES PATENT AND TRADEMARK OFFICE

CERTIFICATE OF CORRECTION

PATENT NO. : 4,429,859

DATED : February 7, 1984

INVENTOR(S) : Steiner et al.

It is certified that error appears in the above-identified patent and that said Letters Patent is hereby corrected as shown below:

Col. 4, line 10, after "ammonium" delete the comma;

Col. 7, line 12, "following" should read --followed--;

Col. 7, line 43, "EX. 50" should read --EX. 5--;

Col. 7, line 45, "-" should read -- --- --.

Col. 7, line 57, "compounds" should read --compound--.

Signed and Sealed this

*Twenty-second* Day of *May 1984*

[SEAL]

*Attest:*

GERALD J. MOSSINGHOFF

*Attesting Officer*

*Commissioner of Patents and Trademarks*